United States Patent [19]

Miller

[11] Patent Number: 4,509,191

[45] Date of Patent: Apr. 2, 1985

[54] ELECTRONIC STEREO REVERBERATION DEVICE

[75] Inventor: Neil A. Miller, Newtonville, Mass.

[73] Assignee: Scholz Research & Development, Waltham, Mass.

[21] Appl. No.: 420,281

[22] Filed: Sep. 20, 1982

[51] Int. Cl.[3] ..... H04R 3/00

[52] U.S. Cl. ..... 381/63; 381/18; 84/DIG. 26

[58] Field of Search ..... 381/61, 17, 62, 18, 381/63; 84/DIG. 26, DIG. 4

[56] References Cited

U.S. PATENT DOCUMENTS

| | | | |
|---|---|---|---|
| 3,881,057 | 4/1975 | Adachi et al. | 381/63 |
| 4,130,726 | 12/1978 | Kates et al. . | |
| 4,215,242 | 7/1980 | Gross | 381/63 |
| 4,268,717 | 5/1981 | Moore | 381/63 |

OTHER PUBLICATIONS

Christopher Moore, "Application Note: Studio Applications of Time Delay," AN-3, 1976, Lexicon, Inc., Waltham, Mass.

*Primary Examiner*—Keith E. George

*Attorney, Agent, or Firm*—Wolf, Greenfield & Sacks

[57] ABSTRACT

A stereo or two channel electronic reverberation device is disclosed comprising an analog delay device which receives audio signals and provides delayed output signals at a plurality of outputs, with the time delay period of each output being different from the delay period of other outputs. Two summing devices each receive inputs from different combinations of the analog delay device outputs to provide two different signals having different reverb components. An additional output delay device is also provided which receives the last output from the analog delay device, delays this signal a time period substantially greater than the time period between any two adjacent analog delay device outputs, and provides this substantially greater delayed signal to only one of said summing devices.

7 Claims, 2 Drawing Figures

RIGHT OUTPUT
LEFT OUTPUT
INPUT SIGNAL
MN3007
IC207
MN3011
IC206
MN3101
IC208
IC203A,B
IC204A,B
IC205A,B
RIGHT
LEFT
206R
206L
D201
20A
22
22A
22B
20
21

ELECTRONIC STEREO REVERBERATION DEVICE

TECHNICAL FIELD

This invention is directed to a reverberation device which alters the output signal of electrical musical instruments or other signals by introducing reverb into these signals.

BACKGROUND OF THE INVENTION

Many prior art devices are available for electrically introducing reverb effects into an output signal from an electrical musical instrument. Many of these devices are susceptible to mechanical jarring, and produce "Boing" type sounds when subject to such jarring or mechanical vibration. At least one prior art reverb unit incorporates a multiple output bucket brigade device, i.e. an analog shift register. However, for certain applications this device is quite noisy or does not provide sufficient delay of the inputted signal, and is limited in the type and quality of the reverb that it provides.

SUMMARY OF THE INVENTION

An object of the invention is to add reverberation to the output signal of an electrical musical instrument such that the resultant signal or signals has superior reverberation characteristics.

In accordance with the invention, a two channel or stereo reverberation device is provided which includes an analog shift register or bucket brigade device having staggered output delay taps, and two summing devices each of which receive output signals from different combinations of the output delay taps, and which sum the signals inputted thereto. In this way, two different channels of reverberation signals are obtained having different reverberation or delay components.

Numerous other advantages and features of the present invention will become readily apparent from the following detailed description of the invention and embodiments thereof, from the claims and from the accompanying drawings.

DETAILED DESCRIPTION OF THE PREFERRED EMBODIMENT

Figure 1:
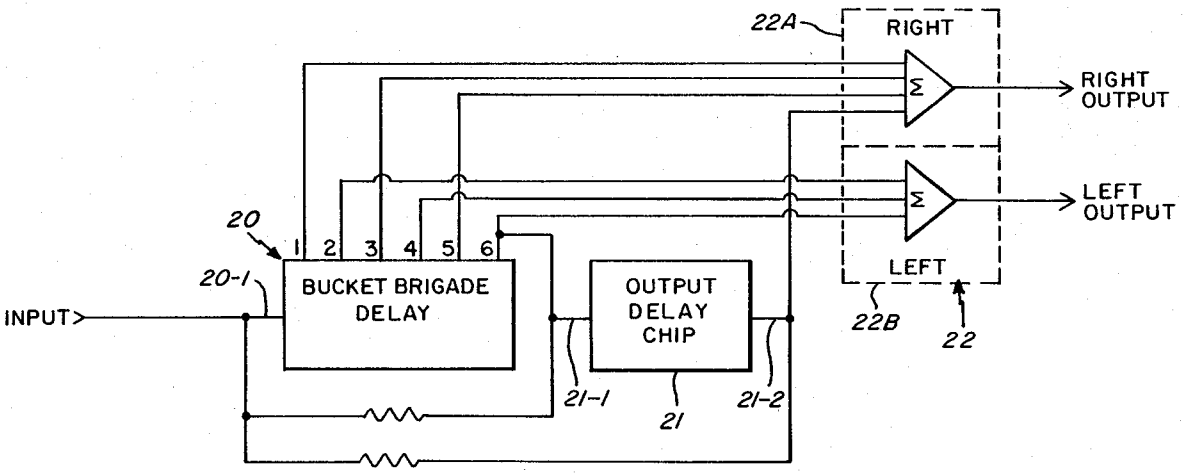
FIG. 1 is an overall block diagram of the reverberation device according to the invention.

As shown in FIG. 1, the reverberation unit comprises a bucket brigade delay device (an analog delay device) 20 which receives an input signal from a musical instrument or the like at the left as shown in the figure. The bucket brigade device has 6 output taps labeled 1 through 6 in FIG. 1. A signal appearing at the input 20-1 of the bucket brigade will appear at the first output delay tap about 20 milliseconds after it is inputted. The delay between adjacent taps is unequal. For example, the inputted signal will appear at the second output delay tap about 12 milliseconds after it appears at the first output, which is about 32 milliseconds after it appears at the input 20-1. The inputted signal will appear at delay taps 3–6 in sequence with irregular delays between each tap. Finally, the signal will appear at the output of the last delay tap about 150 milliseconds after it is inputted on the 20-1.

The output of the last delay tap is inputted to an output delay circuit 21 at an input line 21-1. The output delay circuit will produce the inputted signal at its output 21-2 about 50 milliseconds after it appears at its input 21-1.

The outputs of the bucket brigade are connected to a summing circuit 22 comprising right and left summers 22A and 22B, respectively. Right summer 22A receives alternate outputs from the bucket brigade 20, i.e. delay taps 1, 3 and 5, while the left summer 22B receives different alternate outputs from the bucket brigade 20, i.e. delay taps 2, 4 and 6. The right summer will also receive the output from the output delay circuit 21. However, this output at line 20-1 from output delay circuit 21 will not be provided to the left summer. In this manner, not only will the right summer receive different combinations of outputs from bucket brigade 20 than the right summer, but the left summer will receive an additional delay output, i.e. the output from output delay circuit 21. Therefore, the outputs 22-1 and 22-2 of the summers 22A and 22B will have different delay components.

The result of adding these two separate groups of irregularly spaced delay components is to create two highly complex frequency responses, with many peaks and valleys which are not correlated to each other. When these two different signals are fed to separate sound transducers or a stereo amplifier and speaker system for e.g., the sounds produced by the two summers will create a stereo image.

Figure 2:
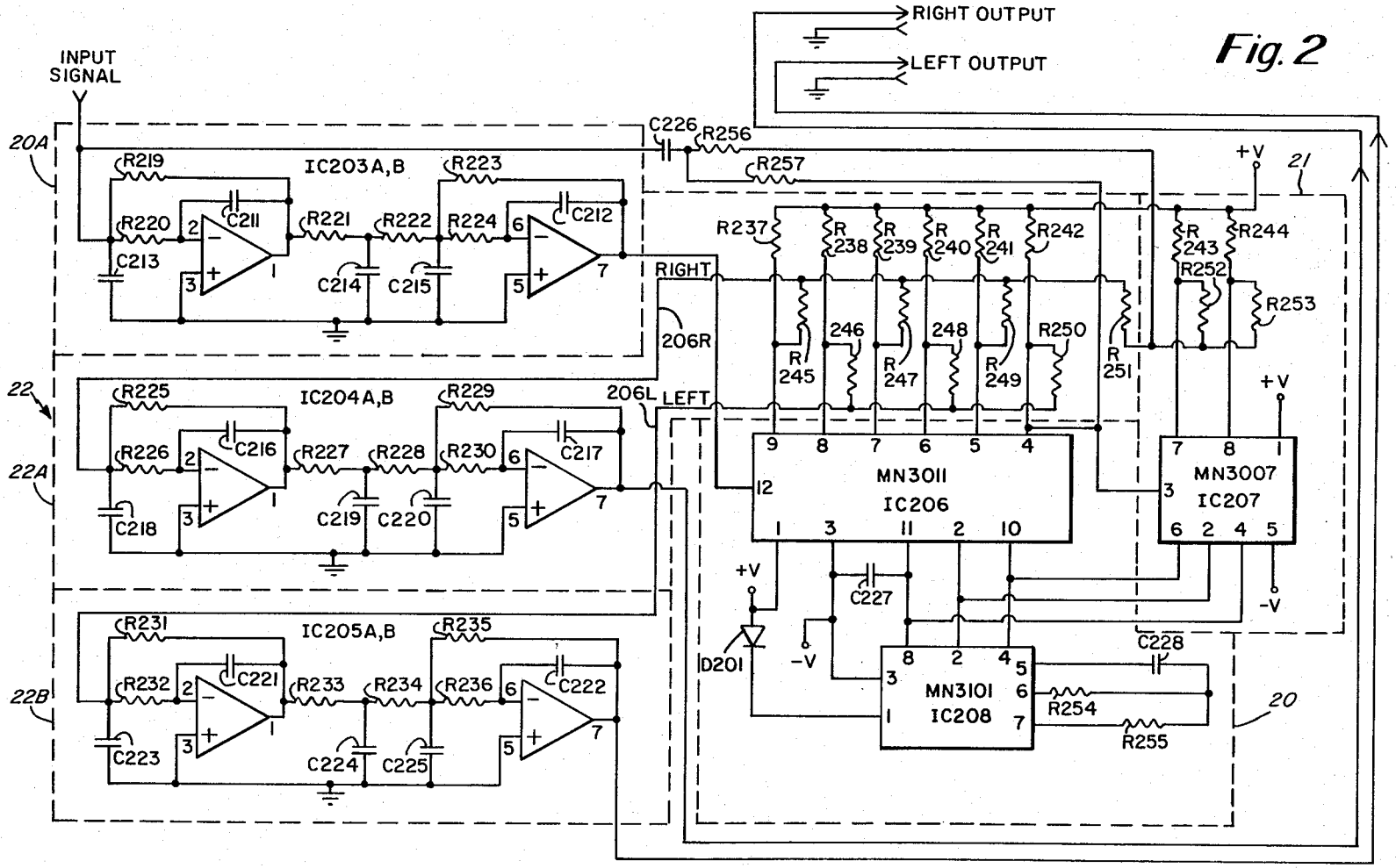
FIG. 2 is an electrical schematic showing the block diagram of FIG. 1 in more detail.

As shown in more detail in FIG. 2, the bucket brigade circuit 20 receives an audio signal at the input of its buffer amplifier and filter circuit portion 20A. The buffer amplifier and filter circuit portion comprises two integrated circuits IC 203A, and IC 203B and associated resistors and capacitors, and provides an amplified and filtered signal to pin 12 of the bucket brigade device IC 206.

The integrated circuit IC 206 is an analog shift register having 6 output delay taps at pins 4–9 thereof. Integrated circuit IC 208 is an analog shift register clock generator/driver which drives both integrated circuits IC 206 and IC 207. The period of switching of the timer is dependent upon the circuit values of resistors R 254, R 255 and capacitor C 228. The bucket brigade IC 206 receives an input signal at pin 12 and provides this signal in sequence to the output delay taps (pins 4–9). The delay between taps is irregular, ranging from about 10 to about 30 milliseconds. Finally, a signal is outputted at the last delay tap (pin 4) about 150 milliseconds after it is received at input pin 12 of IC 206.

The output of the last delay tap (pin 4) is provided to pin 3 of an additional output delay integrated circuit chip IC 207, which is also an analog shift register like IC 206 but with fewer stages. IC 207, at pins 7 and 8, provides a delayed output about 50 milliseconds after it receives an input at its pin 3.

The output of output delay taps 4–9 of bucket brigade IC 206 and delay taps 7 and 8 of IC 207 are fed into a resistor summing network comprising resistors R 245 through R 251. As seen in FIG. 2, the outputs of alternate pins 4, 6 and 8 are summed on the lower output line 206L (left channel), whereas the outputs of alternate pins 5, 7 and 9 are summed on the upper output line 206R (right channel). Further, the output of the additional output delay chip IC 207 is fed to only the upper output line 206R (right channel).

The output of the upper output line 206R (right channel) is fed to the input of a right output amplifier and filter comprising integrated circuits IC 204A, IC 204B, associated resistors R 225 through R 230 and capacitors C 216 through C 220. The output of this right output amplifier and filter appears at pin 7 of IC 204B and is available to be connected to the input of a sound transducer, an amplifier and speaker system, a mixing console, or a sound recording device.

Similarly, the output of the lower line of summing resistors (left channel) is fed to the left output amplifier and filter circuit comprising IC 205A, IC 204B, associated resistors R 231 through R 236, and capacitors C 221 through C 225. The output of the left output amplifier and filter circuit appears at pin 7 of IC 205B and is available to be connected to the input of a sound transducer, an amplifier and speaker system, a mixing console, or a sound recording device or the like.

Therefore, in accordance with the present invention, a two channel or stereo reverberation device is provided wherein each channel provides an output signal having different and distinct sound characteristics.

Table I attached hereto lists the values of the circuit components described herein. However, it is to be understood that the invention is not limited to the precise circuit values or even the specific embodiment described above, and no limitation with respect to the specific apparatus illustrated herein is intended or should be inferred. It can be appreciated that numerous variations and modifications may be effected without departing from the true spirit and scope of the novel concept of the invention. It is of course intended to cover by the appended claims all such modifications as fall within the scope of the claims.

TABLE I

| | | | |
|---|---|---|---|
| R 219 | 100K | R 247 | 120K |
| R 220 | 33K | R 248 | 120K |
| R 221 | 47K | R 249 | 150K |
| R 222 | 56K | R 250 | 150K |
| R 223 | 100K | R 251 | 150K |
| R 224 | 33K | R 252 | 5.6K |
| R 225 | 100K | R 253 | 5.6K |
| R 226 | 33K | R 254 | 120K |
| R 227 | 47K | R 255 | 22K |
| R 228 | 56K | R 256 | 470K |
| R 229 | 100K | R 257 | 390K |
| R 230 | 33K | C 211 | 220 pf |
| R 231 | 100K | C 212 | 220 pf |
| R 232 | 33K | C 213 | 2700 pf |
| R 233 | 47K | C 214 | 2700 pf |
| R 234 | 56K | C 215 | 2700 pf |
| R 235 | 100K | C 216 | 220 pf |
| R 236 | 33K | C 217 | 220 pf |
| R 237 | 56K | C 218 | 2700 pf |
| R 238 | 56K | C 219 | 2700 pf |
| R 239 | 56K | C 220 | 2700 pf |
| R 240 | 56K | C 221 | 220 pf |
| R 241 | 56K | C 222 | 220 pf |
| R 242 | 56K | C 223 | 2700 pf |
| R 243 | 100K | C 224 | 2700 pf |
| R 244 | 100K | C 225 | 2700 pf |
| R 245 | 100K | C 226 | 3.3 uf |
| R 246 | 100K | C 227 | 3.3 uf |
| C 228 | 220 pf | IC 205 | TL 072 |
| D 201 | IN 9114 | IC 206 | MN 3011 |
| IC 203 | TL 072 | IC 207 | MN 3007 |
| IC 204 | TL 072 | IC 208 | MN 3101 |

What is claimed is:

1. An electronic reverberation device for providing reverberation to signals in the audio frequency range, comprising:

an input terminal and a pair of output terminals corresponding to right and left stereo output signals, respectively;

an analog delay device having an input coupled from said input terminal for receiving an input audio signal and including a plurality of successive output taps separated into at least first and second output tap groups with at least some of the output taps of the first group being timewise interleaved with output taps of the second group;

said successive output taps having a delay period defined therebetween with at least some of said delay periods being of different length than an adjacent delay period;

a feedback path coupling from at least one of said output taps of said analog delay device to said analog delay device input;

first and second summing devices each having multiple inputs and an output;

means coupling the output taps of the first group only to the inputs of the first summing device;

means coupling the output taps of the second group only to the inputs of the second summing device;

means coupling the output of each of the summing devices to one of the pair of output terminals;

said summing devices for summing the signals inputted thereto to provide two different audio output signals having different delay components, an output delay circuit having an input and an output and means coupling the input thereof from an output tap of the analog delay device, said feedback path including a first feedback path coupled from the output tap that couples to the output delay circuit to the analog delay device input and a second feedback path that couples from the output of the delay circuit to the analog delay device input, means coupling the output of the output delay circuit to only one of said summing devices at an input thereto, wherein each output delay tap is connected to provide an input to only one summing device.

2. The electronic reverberation device according to claim 1 wherein the output taps of the first group are of odd sequence (t1, t3, t5, etc.) and the output taps of the second grojup are of even sequence (t2, t4, t6, etc.).

3. The electronic reverberation device according to claim 1 wherein the analog delay device is a bucket brigade.

4. The electronic reverberation device according to claim 1 wherein the analog delay device has a number of output delay taps, and wherein each summing device is connected to receive half of said output delay taps.

5. The electronic reverberation device according to claim 1 wherein the analog delay device has six output delay taps.

6. The electronic reverberation device according to claim 1 wherein the delay period between adjacent output taps is unequally spaced, in the range of 10 to 30 millseconds.

7. The electronic reverberation device according to claim 1 wherein the delay period between the analog delay device input and the last delay tap is about 150 milliseconds.

* * * * *